US008689904B2

(12) United States Patent
Coates et al.

(10) Patent No.: US 8,689,904 B2
(45) Date of Patent: Apr. 8, 2014

(54) DETECTION OF GAS INFLUX INTO A WELLBORE

(75) Inventors: Richard T. Coates, Middlebury, CT (US); Benoit Froelich, Marly le Roi (FR); Eric Lavruit, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 377 days.

(21) Appl. No.: 13/115,988

(22) Filed: May 26, 2011

(65) Prior Publication Data

US 2012/0298421 A1 Nov. 29, 2012

(51) Int. Cl.
*E21B 47/00* (2012.01)

(52) U.S. Cl.
USPC ..... 175/50; 175/57; 166/250.01; 367/81

(58) Field of Classification Search
USPC ..... 166/336, 335, 250.1, 66, 250.03, 64; 175/50, 57, 107, 371, 65, 48, 70; 367/81, 131; 340/853.1; 702/9
See application file for complete search history.

(56) References Cited

U.S. PATENT DOCUMENTS

| | | | | |
|---|---|---|---|---|
| 5,275,040 | A | 1/1994 | Codazzi | |
| 5,892,147 | A | 4/1999 | Garnes et al. | |
| 6,208,586 | B1 | 3/2001 | Rorden et al. | |
| 6,606,009 | B2 | 8/2003 | Gunawardana et al. | |
| 2008/0047337 | A1 | 2/2008 | Chemali et al. | |
| 2009/0173150 | A1 * | 7/2009 | DiFoggio et al. | 73/152.19 |

OTHER PUBLICATIONS

J.M. Carcione, F. Poletto, "Sound velocity of drilling mud saturated with reservoir gas," Geophysics, vol. 65, No. 2, 2000, pp. 646-651.
International search report for the equivalent PCT patent application No. PCT/US2012/038758 issued no Nov. 29, 2012.

* cited by examiner

*Primary Examiner* — Yong-Suk (Philip) Ro
(74) *Attorney, Agent, or Firm* — Daryl Wright; Jody DeStefanis

(57) ABSTRACT

An influx of gas into a borehole can be detected by deploying a string of acoustic sensors along a drill string or other conduit to monitor an acoustic characteristic, such as velocity or attenuation, of the drilling fluid present in the borehole. In response to detection of acoustic pulses propagating in the drilling fluid, the acoustic sensors generate signals that are representative of acoustic characteristics if the drilling fluid. Based on the generated signals, a data acquisition system can determine whether a change in the monitored acoustic characteristic is indicative of a gas influx.

14 Claims, 2 Drawing Sheets

DETECTION OF GAS INFLUX INTO A WELLBORE

BACKGROUND

1. Technical Field

Embodiments of the present disclosure relates generally to hydrocarbon production and, more particularly, to real-time detection of the influx of gas into a wellbore during drilling operations.

2. Background Description

The following descriptions and examples are not admitted to be prior art by virtue of their inclusion in this section.

Exploration and production of hydrocarbons commonly include using a drill bit attached to a bottom hole assembly (BHA), which is in turn attached to a length of hollow drill pipe reaching to the surface to drill a well. Drilling fluid, or "mud," is injected down the conduit formed by the drill pipe, through the BHA, and out of the drill string into the annulus between the drill pipe and the borehole through nozzles in the drill bit. The drilling mud has many functions, including lifting the rock cuttings generated by the drill bit and transporting them to the surface; lubricating and cooling the drill bit; generating power for the instruments mounted in the BHA; acting as a telemetry conduit for acoustic pulses propagating inside the drill pipe; and maintaining hydraulic pressure on the formation to prevent unwanted influx of oil, gas or water into the borehole during the drilling process.

With respect to this latter function, drilling operators typically vary the mixture of gases, liquids, gels, foams and/or solids mixed into the drill mud and injected into the drill pipe to maintain hydraulic pressure at desired levels. In addition, drilling operators typically adjust a choke at the surface to regulate back pressure on the circulation of the fluids in the annulus between the drill pipe and the borehole. By controlling the hydrostatic and back pressure, production of fluid from the penetrated zones may be controlled from the surface during drilling.

However, on occasion, the pressure the drill mud exerts on the formation may fall below the pressure of fluid in the pores of the formation, or in pre-existing fractures in the formation. When this occurs, pore fluids may flow unintentionally into the borehole. Such an event is referred to as a "kick" and can cause undesirable conditions, particularly if the fluid flowing into the borehole is a gas or a fluid containing a dissolved gas. Since the gas "kick" expands dramatically as it migrates up the borehole to regions of lower hydrostatic pressure, a gas kick event could require the well to be shut in at the blow-out preventer, and time consuming measures must be taken to gradually release the gas from the annulus in a controlled manner. In extreme cases, if the kick is not detected, a blow-out can occur.

Known methods for detecting abnormal formation pressure which could be indicative of a gas kick generally are based on measurements of various drilling parameters, including rate of penetration, torque and drag, drilling mud parameters (e.g., mud-gas cuttings), flow line mud weight, pressure kicks, flow line temperature, mud level in the mud pits, mud flow rate, shale cutting parameters (e.g., bulk density, shale factor, volume and size of shale cuttings), etc. All of these measurements suffer from the drawback that there is substantial delay between the influx of the gas into the borehole and its manifestation in these measurements at the surface. Because of this delay, corrective action may not be initiated in as timely a manner as may be desired.

Other known methods for detecting kicks rely on downhole density measurements of the borehole fluid. Limitations of these methods include the fact that the dissolved gas that may be a precursor to a kick may not be detected; the sensor provides only a point measurement and is insensitive to gas elsewhere in the mud column, particularly at locations above the sensor; distinguishing changes in mud density from fluctuations in formation density can be difficult; and some techniques may require a radioactive source.

SUMMARY

In accordance with an embodiment of this disclosure, a method of detecting an influx of gas into a borehole may comprise deploying a drill string into a borehole extending from an earth surface into a formation and providing a drilling fluid in the borehole. In addition, the method may comprise providing a plurality of acoustic sensors at respective locations along the length of the drill string to detect, at each of the acoustic sensors, acoustic pulses propagating in the drilling fluid along the length of the drill string wherein each of the acoustic sensors generates an electrical signal responsive to the detection of each of the acoustic pulses. Further, the method may include determining a change in an acoustic characteristic of the drilling fluid based on the generated signals and determining presence of an influx of gas into the borehole based on the determined change.

In accordance with another embodiment of this disclosure, a method of detecting an influx of gas into a borehole may comprise generating a plurality of acoustic pulses that propagate in a fluid present in a borehole in which a conduit is deployed, the borehole extending from an earth surface into a formation and observing an acoustic characteristic of the fluid at a plurality of sensing locations along the length of the conduit while the acoustic pulses are propagating in the fluid. In addition, the method may include determining presence of an influx of gas into the borehole based on observation of a variation of the acoustic characteristic.

In accordance with another embodiment of this disclosure, a system may comprise a conduit suspended in a fluid present in a borehole extending from an earth surface into a formation and an acoustic source to generate a plurality of acoustic pulses that propagate in the fluid. In addition, the system may comprise a plurality of acoustic sensors disposed at spaced apart locations along the length of the conduit to generate signals responsive to detection of the acoustic pulses and a data acquisition system to receive the generated signals, the data acquisition system further to determine a variation in an acoustic characteristic of the fluid based on the received signals, and to determine presences of an influx of gas into the borehole based on the determined variation.

Other or alternative features will become apparent from the following description, from the drawings, and from the claims.

BRIEF DESCRIPTION OF THE DRAWINGS

Certain embodiments of the present disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Figure 1:
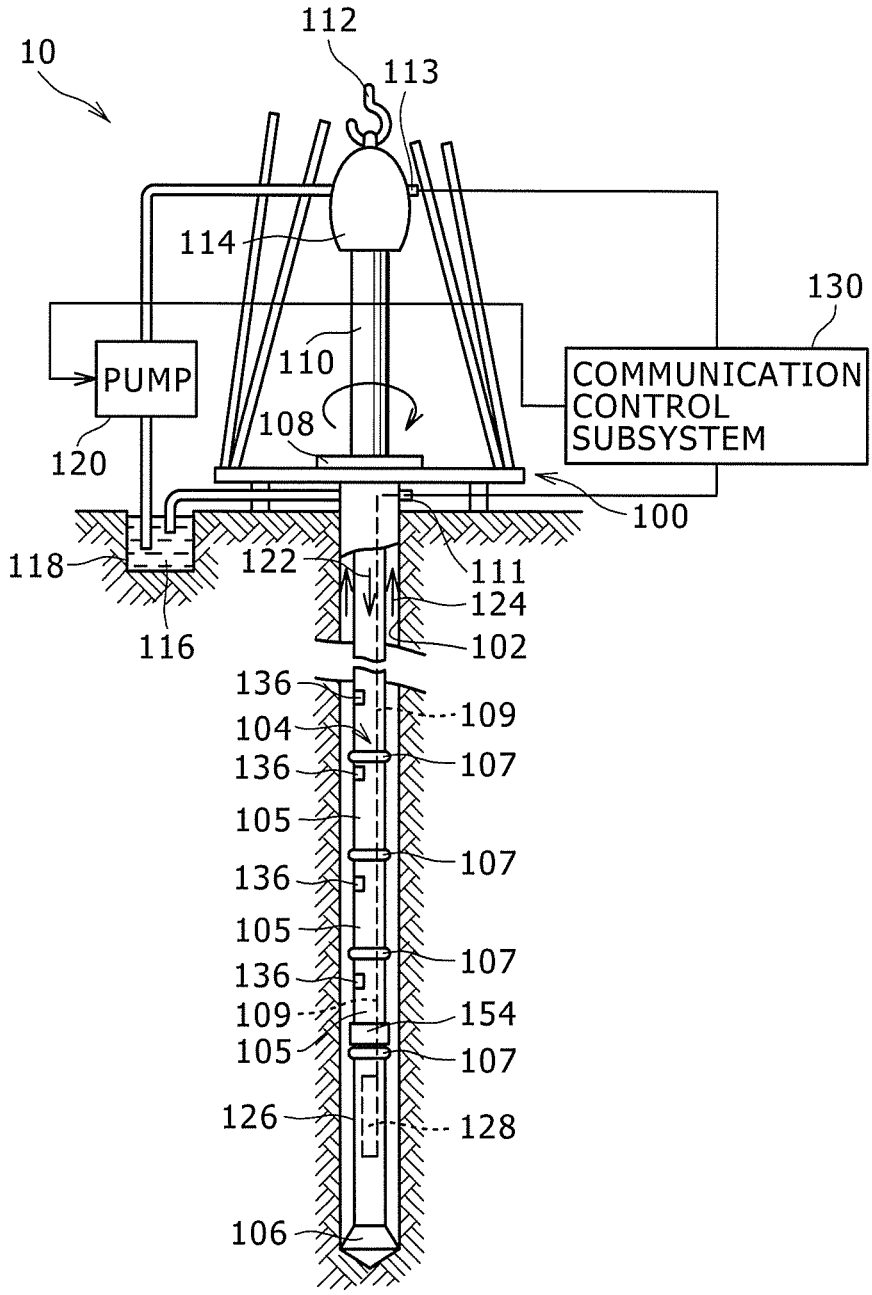
FIG. 1 is an illustrative arrangement of a system for detecting the influx of gas into a borehole, according to an exemplary embodiment of the present disclosure.

In the following description, numerous details are set forth to provide an understanding of the present disclosure. However, it will be understood by those skilled in the art that embodiments of the present disclosure may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

The addition of gas to a fluid alters the acoustic characteristics of the fluid, and, in particular, the acoustic velocity and attenuation. For instance, when gas is in solution with oil, the acoustic velocity of the fluid may be decreased by approximately 20 percent. Similar attenuation in the amplitude of the propagating acoustic wave can occur when gas is in solution with drilling fluid. The magnitude of the change in acoustic characteristics of the gas free mud is only weakly dependent on temperature and pressure. As such, observed changes in fluid acoustic characteristics, and particularly significant changes that occur rapidly in time, can provide a reliable indication that gas has been introduced into the fluid that is present in the borehole. If these observed changes can be communicated to the surface in a timely manner, then an operator can take suitable corrective actions, such as adjusting the composition of the drilling fluid or adjusting various chokes and valves to regulate back pressure, or activating protective mechanisms to prevent a blow-out from occurring.

In addition, if the acoustic characteristics can be monitored at multiple locations along the drill pipe, then the location of the gas influx can be more accurately determined and its upward movement can be monitored. Consequently, communication of the signals that are indicative of this movement can facilitate an operator's decisions as to which control actions should be taken while drilling is progressing. Yet further, gas that enters the wellbore at a location that is above a first sensor may be detected by one or more sensors above the first sensor, thus reducing the chance that an influx will proceed undetected.

Accordingly, illustrative embodiments of the present disclosure observe acoustic characteristics of the fluid in the borehole during drilling operations so that changes in these characteristics, which may be indicative of an influx of gas into the borehole, can be detected in a timely and reliable manner. In accordance with exemplary implementations, a string of acoustic sensors is positioned on the drill string and, optionally or alternatively, on the BHA. These sensors are disposed on the drill string and/or the BHA in a manner in which acoustic pulses or vibrations in the annulus between the drill pipe and the formation can be sensed. These acoustic pulses typically occur at a low frequency (e.g., 1-100 Hertz (Hz)) and are sometimes referred to as tubewaves or Stoneley waves. Synchronization of the sensors with respect to time enables propagation of these acoustic pulses or vibrations to be detected and monitored along the length of the drill string.

Embodiments of the present disclosure provide for communication of information representative of the observed characteristics to the surface through the use of a communication channel that is provided by the drill string. For instance, in some implementations, the communication may be provided by modulating the pressure of the drilling fluid through generation of an acoustic wave that propagates upwardly in the drilling fluid through the center of the drill string (referred to as mud pulse telemetry). In other implementations, the communication channel may be provided through the use of wired drill pipe (WDP) technology.

A wired drill pipe is a type of drill pipe that has one or several electrical communication channels within the structure of the pipe. The pipe structure then serves to protect the communication channel and assist in the movement thereof. Generally, a wired drill pipe has a signal coupler at each end that is coupled to the communication channel(s) carried within the pipe. When the signal coupler of one section of wired drill pipe is placed in proximity to or in contact with the signal coupler of another section of wired drill pipe, signals may be transmitted through the couplers. As such, the signal couplers provide a contiguous signal channel(s) from one end of a series of wired drill pipe sections to the other.

The use of wired drill pipe provides increased signal telemetry speed for use with "measuring while drilling" (MWD) and "logging while drilling" (LWD) instruments as compared to conventional signal telemetry, such as mud pulse telemetry or very low frequency electromagnetic signal transmission. Regardless of the particular type of communication employed, a receiver located at the surface is typically connected to receive data from downhole and relay that data to a surface computer system, either by a hard wired connection or wirelessly. In this manner, implementations of the invention can acquire signals indicative of a gas influx, process and analyze those signals, and/or convey the signals and/or the results to the surface so that corrective action may be taken in a timely manner, if needed and/or desired.

With reference now to FIG. 1, embodiments of the present disclosure can be implemented using the exemplary measuring-while-drilling (MWD) apparatus 10 shown in FIG. 1. In general, measuring-while-drilling refers to the process of taking measurements of parameters of interest in an earth borehole, with the drill bit and at least some of the drill string disposed in the borehole during drilling, pausing, and/or tripping. As shown in FIG. 1, a platform and derrick 100 are positioned over a borehole 102 that is formed in the earth by rotary drilling. A drill string 104 is suspended within the borehole 102 and includes a drill bit 106 at its lower end.

The drill string 104 and drill bit 106 attached thereto are rotated by a rotating table 108 which engages a kelly 110 at the upper end of the drill string 104. The drill string 104 is suspended from a hook 112 attached to a traveling block (not shown). The kelly 110 is connected to the hook 112 through a rotary swivel 114 which permits rotation of the drill string 104 relative to the hook 112. Alternatively, the drill string 104 and the drill bit 106 may be rotated from the surface by a "top drive" type of drilling rig. However, the gas influx detection techniques disclosed herein are not limited to rotary-type drilling operations. For instance, the techniques also may be implemented in applications in which a borehole is drilled using a downhole drilling motor. In other instances, the earth surface may include the underwater surface of a seabed.

Referring still to FIG. 1, during the drilling operation, drilling fluid or mud 116 is contained in a pit 118 in the earth. A pump 120 pumps the drilling mud into the drill string via a port in the swivel 114 to flow downward (arrow 122) through the center of the drill string 104. The drilling mud exits the drill string 104 via ports in the drill bit 106 and then circulates upward (arrow 124) in the region between the outside of the drill string 104 and the periphery of the borehole 102, which is referred to as the annulus. The drilling mud 116 is returned to the pit 118 for recirculation after suitable conditioning. It should be understood, however, that other types of arrangements for deploying and circulating the drilling fluid also are contemplated herein.

In the embodiment shown, the drill string 104 includes a bottom hole assembly (BHA) 126, which typically is mounted close to the bottom of the drill string 104 proximate the drill bit 106. The BHA 126 generally includes capabilities for measuring, processing and storing information, and for communicating with the earth's surface, such as via a local communications subsystem 128 that communicates with a similar communications subsystem 130 at the earth's surface. In the embodiment shown, one of the technologies that the local communications subsystem 128 uses to communicate with the surface communications system 130 is through the use of one or more communication channels provided by a wired drill pipe.

For instance, as shown in FIG. 1, the drill string 104 includes multiple sections of wired drill pipe 105 interconnected with couplers 107. Each section of wired drill pipe 105 contains one or more communication channels within the pipe, such as the communication channel 109 shown schematically in FIG. 1. The couplers 107 are configured to mechanically couple the sections of wired drill pipe 105 to one another and to couple the sections of the communication channel(s) 109 so as to form a contiguous communication channel 109 from one end of the series of interconnected sections of wired drill pipe to the other end.

In the embodiment shown in FIG. 1, the lowermost end of the wired drill pipe 105 is coupled to a bottom hole assembly (BHA) 126 such that the local communications subsystem 128 can transmit and receive communications via the communication channel 109. The uppermost end of the wired drill pipe 105 is coupled through a coupler 111 to the surface communication subsystem 130. In this manner, the communication channel(s) 109 may be used to transmit signals (e.g., telemetry signals or data, command signals, etc.) between the surface and the BHA 128, as well as various other downhole components that may be coupled to the communication channel(s) 109.

In some embodiments, one or more sections of the wired drill pipe 105 may further include a booster module that receives the electrical signal carried on the communication channel(s) 109. The booster module can be configured to filter and amplify the received electrical signals prior to transmitting them back out on the communication channel(s) 109. In this manner, the booster module can improve the signal to noise ratio of the received signals which may be particularly useful when the signals are transmitted over long distances and/or over several sections of wired drill pipe 105.

Figure 2:
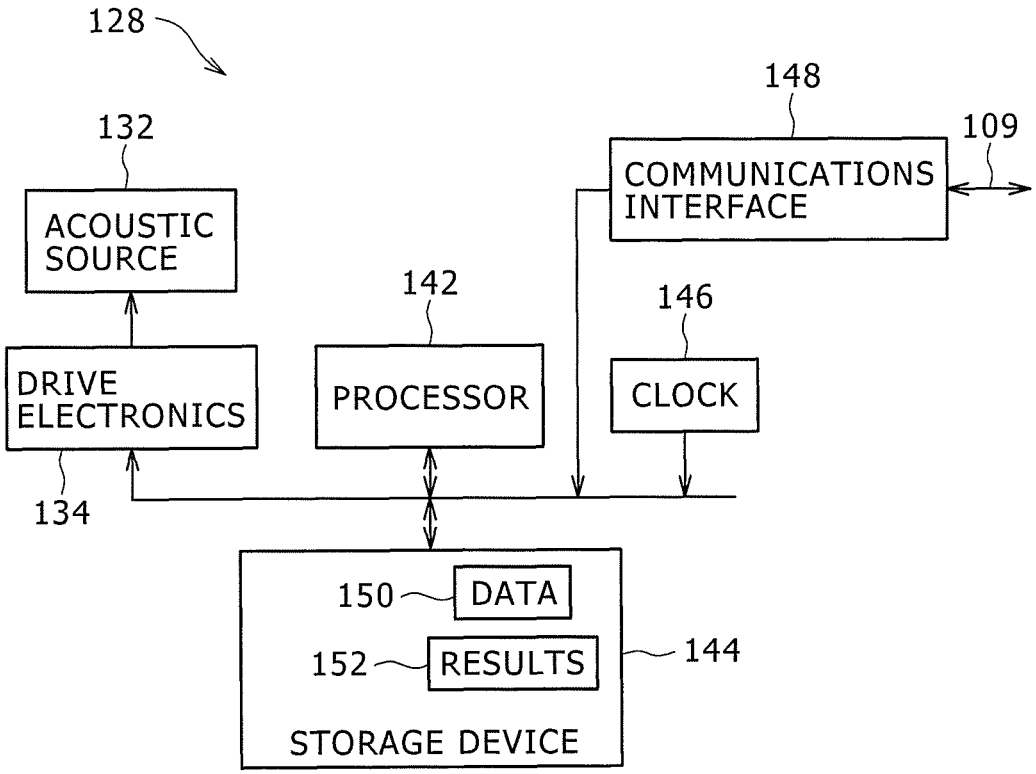
FIG. 2 is a block diagram of an exemplary communications and data acquisition system that may be used in the arrangement of FIG. 1, in accordance with an embodiment of the present disclosure.

With reference to FIG. 2, in various implementations of the present disclosure, such as implementations that employ mud pulse telemetry to communicate information to the surface, the local communications subsystem 128 also may include an acoustic source 132 (i.e., a transmitter) that generates an acoustic signal in the drilling fluid that is representative of measured downhole parameters. One type of acoustic source employs a "mud siren," which includes a slotted stator and a slotted rotor that rotates and repeatedly interrupts the flow of drilling mud 116 to establish a desired acoustic wave signal in the drilling mud 116. The local communications subsystem 128 also includes driving electronics 134 to drive the acoustic source 132. For instance, the driving electronics 134 may include a modulator, such as a phase shift keying (PSK) modulator, which produces driving signals for application to the mud transmitter.

These driving signals can be used to apply appropriate modulation to the mud siren 132 to generate a desired acoustic signal in the drilling fluid 116 that is representative of the measured downhole parameters. In some embodiments, the drive electronics 134 is coupled to a processor 142 that can execute instructions to produce a desired modulation. The acoustic mud wave generated by the acoustic source 132 travels upward in the drilling fluid 116 through the center of the drill string 104 at the speed of sound in the fluid. The acoustic wave is received at the surface by transducers 113 (e.g., piezoelectric transducers), which convert the received acoustic signals to electronic signals. The output of the transducers 113 is coupled to the surface communication subsystem 130, which is operative to demodulate, process, and/or analyze the signals.

In other embodiments, the electronic signals representative of measured downhole parameters are generated downhole and are transmitted to the surface via one or more WDP communication channel(s) 109. For instance, in some embodiments, the electronic signals may be generated by downhole sensors in response to a detected parameter, communicated to the local communications system 128 in the BHA 126, processed and stored at the BHA 126, and then transmitted to the surface communications subsystem 130 via the WDP communication channel(s) 109. Alternatively, the electronic signals generated by downhole sensors may be transmitted directly to the surface communications system 130 via the WDP communication channel 109.

In the exemplary arrangement shown in FIG. 1, a plurality of acoustic sensors 136 are disposed along the length of the drill string 104 at spaced apart intervals. Although only one sensor 136 is shown on each section of the drill pipe 105, each section may carry multiple sensors 136. Alternatively, sections of drill pipe 105 containing one or more sensors 136 may be separated by sections of drill pipe 105 which contain no sensors. Yet further, although the sensors 136 are shown as aligned on one side of the drill string 104, the sensors 136 may be arranged in any manner that is best suited to detect and monitor propagation of an acoustic signal through the drilling fluid 116.

In FIG. 1, the sensors 136 are arranged to detect an acoustic signal propagating in the annulus formed between the periphery of the borehole 102 and the drill string 104. In some embodiments, the sensors 104 also may be disposed on the BHA 126. Regardless of the manner in which the sensors 136 are disposed along the drill string 104 and/or BHA 126, the sensors 136 communicate the signals generated in response to detection of the acoustic signal in the drilling fluid to the local communications subsystem 128 and/or the surface communication subsystem 130.

Figure 3:
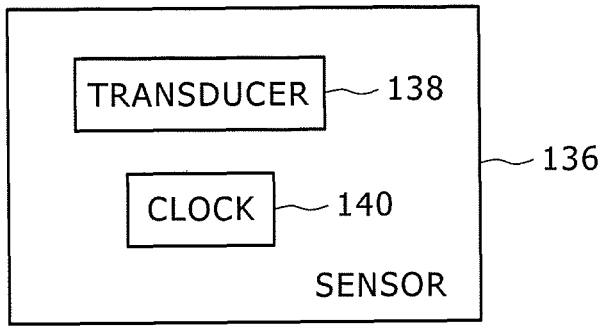
FIG. 3 is a block diagram representation of an exemplary sensor that may be used in the arrangement of FIG. 1, in accordance with an embodiment of the present disclosure.

In certain embodiments, and as shown in FIG. 3, each sensor 136 not only includes a transducer 138 to convert a pressure signal exerted on the sensor 136 by the acoustic signal to an electronic signal, but the sensor 136 also may include a clock 140 that may be used to associate a time indication with the generated electronic signal. The clocks 140 included with the sensors 136 may be time synchronized so that parameters associated with propagation of the acoustic wave (e.g., velocity, location) can be accurately determined.

With reference again to FIG. 2, the local communications subsystem 128 may further include data acquisition and processing electronics (including a microprocessor 142, storage device 144, clock and timing circuitry 146, communication interface 148, etc.) for receiving and processing the electronic signals generated by the sensors 136 in response to detection of the acoustic signal. The communications interface 148 may include a suitable receiver and transmitter for acquiring and sending information on the communication channel(s) 109. The local subsystem 128 may use the processor 142 to process and store the signals received via the communication interface 148 along with their respective arrival times (either as indicated by the clocks 140 (FIG. 3) included with each sensor 136 or as indicated by the clock 146 in the local communication subsystem 128), as well as any results obtained by processing the received signals. The signals and results may be stored in the storage device 144 at the local communications system 128 for later transmission to the surface for further processing and/or archival storage.

In some implementations, the signals and/or results may be immediately transmitted to the surface communication subsystem 130 via the communications interface 148 and WDP communication channel 109 for processing and/or analysis so that appropriate control or corrective action may be taken (e.g., by a drilling operator) in the event that the signals generated by the sensors are indicative of an influx of gas. For instance, if the signals generated by the sensors 136 based on monitoring the acoustic characteristics of the drilling fluid 116 (FIG. 1) (i.e., by monitoring the propagation of the acoustic pulse through the drilling fluid 116) indicate the influx of gas into the borehole, then the drilling operator may take various actions, including varying the composition of the drilling fluid 116 to adjust the hydrostatic pressure in the borehole, adjusting various chokes or valves, etc. Towards that end, the surface communications subsystem 130 may be configured substantially the same as the local communications subsystem 128. That is, the subsystem 130 may include acquisition and processing electronics (e.g., a microprocessor, storage device, communications interface, clock and timing circuitry, etc.) to receive, process, and/or analyze the signals received from either the sensors 136 and/or the BHA 126.

In embodiments in which mud pulse telemetry is used as the communication medium, the data 150 and/or results 152 may be communicated to the surface communication subsystem 130 by appropriate modulation of the acoustic source 132 to generate acoustic signals in the drilling fluid 116 that travel upward through the center of the drill pipe 104.

In general, the influx of gas into the borehole can be determined by detecting a change in the acoustic characteristics of the drilling fluid 116 that is present in the annulus between the drill string 104 and the borehole 102. These characteristics include acoustic velocity and attenuation, each of which varies significantly (i.e., in the range of approximately 10 to 20%) when gas is introduced into the fluid 116. By arranging the sensors 136 along the length of the drill string 104 so that they are disposed at various locations in the borehole (or, alternatively, on the BHA 126), the propagation of one or more acoustic pulses within the drilling fluid 116 may be monitored. By monitoring the travel time(s) of the pulse(s) between sensors 136 and/or the amplitude(s) of the pulse(s) as it(they) moves between sensors 136, an influx of gas into the borehole can be detected and/or located. For instance, the monitored travel times of the one or more pulses may reveal that a change in the acoustic velocity of the drilling fluid has occurred and that the magnitude of this change is indicative of the presence of gas circulating in the drilling fluid 116. Likewise, observation of the amplitude of the pulse(s) may provide an indication that the attenuation of the drilling fluid 116 has changed and, thus, that gas has been introduced into the fluid 116.

In some embodiments, detection of an influx of gas may be determined based on the travel times and amplitudes of a particular acoustic pulse as it propagates between sensors. For instance, the magnitude of an observed travel time or amplitude may be compared to an expected travel time or amplitude value. If the difference between the observed and expected values exceeds a threshold value, then an influx of gas is indicated. As another example, the observed travel times of different pulses propagating in the fluid 116 at different times between any two or more particular sensors 136 and/or the observed amplitudes of the different pulses at any particular sensor 136 may be compared. Again, if the difference between observed values exceeds a threshold (e.g., exhibits a 10-20% change), then the presence of gas in the drilling fluid 116 is indicated.

To determine these changes, either of the local communications subsystem 128 and the surface communications subsystem 130 can be configured with any appropriate change detection algorithm to detect the variations in velocity and/or amplitude of the acoustic pulses. If a variation exceeds a predetermined threshold (e.g., a time or amplitude threshold), then an alarm (e.g., an audible or visual alarm) or other indicator can be generated and conveyed to the drilling operator so that corrective actions may be initiated.

In exemplary implementations, monitoring the propagation of one or multiple acoustic pulses in the drilling fluid is facilitated through synchronization between the sensors 136. Such synchronization may be achieved through the use of highly accurate downhole clocks (e.g., clock 140) that are integrated or deployed with each of the pressure sensors 136 and synchronized before drilling operations commence (e.g., at the surface). Here, a "highly accurate" downhole clock refers to a clock that does not drift more than 5 milliseconds/day, and preferably not more than 1 to 4 milliseconds/day when exposed to the environmental conditions typically found in a wellbore. An example of a suitable highly accurate downhole clock is disclosed in U.S. Pat. No. 6,606,009, the disclosure of which is hereby incorporated by reference. When the sensors 136 are time-synchronized, velocity of the acoustic pulses, as well as locations of the pulses, can be determined with sufficient accuracy to detect and/or locate an influx of gas into the borehole.

Use of highly accurate downhole clocks 140 integrated with each sensor 136 can be particularly useful in embodiments which do not employ WDP technology. That is, due to the low drift of the highly accurate clocks, repeated or continuous synchronization may not be needed after the initial synchronization of the clocks 140 at the time of deployment. When WDP technology is used, however, the low latency of the WDP communication channel(s) 109 may reduce any need for "highly accurate clocks or even the integration of clocks 140 with each sensor 136. For instance, when a low-latency WDP communication channel 109 is available, occasional or periodic synchronization messages exchanged among the clocks 140 can serve to maintain time synchronization sufficient to monitor propagation of acoustic pulses in the fluid present in the borehole 102. Alternatively, in embodiments in which a clock 140 is not integrated with each sensor 136, the sensors 136 can maintain time-synchronization via a continuous communication received on the WDP communication channel 109 from a master clock located either at the surface or a downhole location, e.g., local communications subsystem 128.

Regardless of the particular time-synchronization technique that is implemented, in some embodiments, acoustic pulses are generated in the drilling fluid 116 on a known schedule, such as a known but irregular schedule. As the pulses propagate through the drilling fluid 116, the pulses are detected by the sensors 136 distributed along the drill string 104 and the generated signals are communicated to the surface communications subsystem 130 via the WDP communications channel 109. In another implementation, data representative of the observed pulses are recorded by the local communication subsystem 128 in the storage device 144 along with their arrival times (or phase) (e.g., data 150 in FIG. 2). Data 150 corresponding to selected travel times (or phase) can then be communicated to the surface communications subsystem 130 for processing and analysis using either the WDP communication channel 109 or by modulating the pressure of the fluid 116 in the center of the drill string 104 via the acoustic source 132. Alternatively, the signals may be processed by the local communication subsystem 128 to determine the presence of a gas influx and the results 152 stored in storage device 144. In such embodiments, only the results 152 may be communicated to the surface system 130 via the communication channel 109 or acoustic source 132.

In various implementations, the acoustic pulses that are detected by the sensors 136 can be generated by the rotation of the drill bit 106 and/or the drilling process. In another implementation, the acoustic pulses can be generated at the surface. For instance, the surface communications subsystem 130 may include an uphole transmitting subsystem that can control interruption of the operation of the pump 120 in a manner that generates acoustic pulses that are detectable by the sensors 136 as the resultant tubewaves travel downward through the borehole 102. Alternatively, acoustic pulses can be generated in the annulus by the rapid closing of a choke-valve on the outlet pipe, such as the choke 154 shown schematically in FIG. 1.

Although the embodiments of the present disclosure described thus far contemplate detecting influx of gas during drilling operations, it should be understood that the invention may be implemented in a preexisting borehole in which a fluid other than a drilling fluid (e.g., a production fluid) is present and/or from which the drill string 104 has been pulled and another conduit (e.g., a casing and/or production tubing) has been deployed. In such implementations, the sensors 136 (either with or without clocks 140) may be deployed in the wellbore, such as by use of a wireline, and the wireline can provide the communication channel between the sensors 136, the surface (e.g., subsystem 130), and/or a downhole location (e.g., subsystem 128) for both data communication and synchronization messages.

In the foregoing description, data and instructions are stored in respective storage devices (such as, but not limited to, storage device 144 in FIG. 2) which are implemented as one or more non-transitory computer-readable or machine-readable storage media. The storage devices can include different forms of memory including semiconductor memory devices; magnetic disks such as fixed, floppy and removable disks; other magnetic media including tape; optical media such as compact disks (CDs) or digital video disks (DVDs); or other types of storage devices.

While aspects of the detection method and system have been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the present disclosure.

What is claimed is:

1. A method of detecting an influx of gas into a borehole, comprising:

deploying a drill string into a borehole extending from an earth surface into a formation;

providing a drilling fluid in the borehole;

providing a plurality of acoustic sensors at respective locations along the length of the drill string to detect, at each of the acoustic sensors, at least one acoustic pulse propagating in the drilling fluid along the length of the drill string, wherein each of the acoustic sensors generates an electrical signal responsive to the detection of the acoustic pulse;

determining a change in an acoustic characteristic of the drilling fluid based on the generated signals; and determining presence of an influx of gas into the borehole based on the determined change.

2. The method as recited in claim 1, wherein the drill string comprises a wired drill pipe to provide a communication channel, and the method further comprises transmitting the generated signals via the communication channel to a data acquisition system to determine the presence of the influx of gas.

3. The method as recited in claim 1, further comprising determining, based on the generated signals, acoustic velocities of the acoustic pulse, and wherein presence of an influx of gas is determined based on changes of the acoustic velocities.

4. The method as recited in claim 1, further comprising determining, based on the generated signals, amplitudes of the acoustic pulse at sensor locations, and wherein presence of an influx of gas is determined based on changes of the amplitudes at different sensor locations along the borehole.

5. The method as recited in claim 1, further comprising determining, based on the generated signals, a location of the influx of gas along the length of the borehole.

6. The method as recited in claim 1, further comprising in response to determining presence of an influx of gas, generating an indication of the presence of the influx of gas that is perceptible to a user.

7. The method as recited in claim 6, further comprising initiating an operative action in response to the indication.

8. A system, comprising:

a conduit suspended in a drilling fluid present in a borehole extending from an earth surface;

an acoustic source to generate at least one acoustic pulse that propagates in the drilling fluid;

a plurality of acoustic sensors disposed at spaced apart locations along the length of the conduit to generate signals responsive to detection of the acoustic pulse; and a data acquisition system to receive the generated signals, the data acquisition system further to determine a variation in an acoustic characteristic of the drilling fluid based on the received signals, and to determine presence of an influx of gas into the borehole based on the determined variation.

9. The system as recited in claim 8, wherein the data acquisition system is located at a downhole location in the borehole.

10. The system as recited in claim 8, wherein the data acquisition system is located at the earth surface.

11. The system as recited in claim 8, wherein the acoustic characteristic is at least one of velocity or attenuation.

12. The system as recited in claim 8, wherein the conduit comprises a wired drill pipe including a communication channel to electrically transmit information between the surface and a downhole location.

13. The system as recited in claim 8, further comprising:

a synchronized clock at each sensor, wherein the signals generated by each sensor further indicate a time at which a corresponding acoustic pulse was detected by the sensor, wherein the time is measured by the synchronized clock at the sensor.

14. The system as recited in claim 8, wherein the at least one acoustic pulse has a frequency spectrum of 1-100 Hz.

* * * * *

UNITED STATES PATENT AND TRADEMARK OFFICE

CERTIFICATE OF CORRECTION

PATENT NO. : 8,689,904 B2
APPLICATION NO. : 13/115988
DATED : April 8, 2014
INVENTOR(S) : Richard T. Coates et al.

It is certified that error appears in the above-identified patent and that said Letters Patent is hereby corrected as shown below:

On the Title Page:

Item (75) should be corrected as follows.

Incorrect: Eric Lavruit

Correct: Eric Lavrut

Signed and Sealed this
Twenty-seventh Day of May, 2014

Michelle K. Lee

Michelle K. Lee
*Deputy Director of the United States Patent and Trademark Office*